US005311995A

United States Patent [19]

Terry

[11] Patent Number: 5,311,995

[45] Date of Patent: May 17, 1994

[54] STACK FOR STORING IMBRICATED SHEETS

[75] Inventor: James D. Terry, Edmonds, Wash.

[73] Assignee: Graphic Management Associates, Inc., Southborough, Mass.

[21] Appl. No.: 724,763

[22] Filed: Jul. 2, 1991

[51] Int. Cl.[5] ..... B65D 69/00

[52] U.S. Cl. ..... 206/449; 206/386; 206/821

[58] Field of Search ..... 198/347.1, 347.4; 414/789.5, 791.6, 794, 794.2, 794.4, 796.2; 206/451, 449, 494, 526, 554, 821, 386

[56] References Cited

U.S. PATENT DOCUMENTS

| | | | |
|---|---|---|---|
| 1,386,717 | 8/1921 | Luckett et al. | 206/449 |
| 3,612,300 | 10/1971 | Berghgracht | 414/794 X |
| 3,729,367 | 4/1973 | Shore et al. | 206/494 X |
| 4,416,376 | 11/1983 | Scheffers et al. | 206/554 |
| 4,701,091 | 10/1987 | Yamauchi et al. | 414/791.6 X |
| 4,927,318 | 5/1990 | Hayden et al. | 414/791.6 X |
| 4,984,963 | 1/1991 | Bon | 414/789.5 |
| 5,135,351 | 8/1992 | Rathert | 414/789.5 |

*Primary Examiner*—Michael S. Huppert
*Assistant Examiner*—Janice Krizek
*Attorney, Agent, or Firm*—Jordan B. Bierman

[57] ABSTRACT

Imbricated or overlapped copies of printed material are formed within a plurality of rows to form a single layer of a multi-layered and cubic-shaped stack. The stack allows for more efficient use of space within the storage of printed materials, and allows for easier and faster storing and retrieving of printed materials. The apparatus for forming the stack includes a plurality of in-feed conveyors which feed imbricated copy stream segments to a shuttle assembly upon a plurality of side-by-side rows. Once filled, the shuttle is positioned over a flat separator sheet and drops the plurality of rows onto the separator sheet, thereby forming a single layer. The layer is formed directly upon a stack which is formed upon a pallet. The separator sheet of the formed layer is supported by the copy streams which lie below on the preceding separator sheet. The resulting stack is cubic-shaped and includes a plurality of layers of a plurality of side-by-side rows of relatively flat and horizontal imbricated copy streams that run the full width of the pallet. A method of retrieving the copy streams from the stack to the conveyors uses the same apparatus for forming the stack, and is substantially the reverse of the method of forming the stack.

4 Claims, 15 Drawing Sheets

STACK FOR STORING IMBRICATED SHEETS

BACKGROUND OF THE INVENTION

The present invention relates to a storage assembly for storing imbricated or overlapped copies of printed and folded material upon a pallet. Within the field of printing it is common to temporarily store pre-printed material for later assembly with other printed materials. In the past, this was done by stacking individual printed copies, one on top of another, and placing these vertical stacks upon a pallet. In some cases, partial vertical stacks were tied together to form bundles which were subsequently placed upon pallets. In recent times, the printing industry has recognized that this form of storage is inefficient because it requires a machine to remove individual copies within an imbricated formation upon a conveyor belt and place them one on top of the other in a vertical stack. Conversely, when the stored materials are retrieved, they must be taken from a vertical stack and reformed into an imbricated form upon a conveyor. The machines for doing this type of storage and retrieval are complicated, subject to malfunction, and are relatively slow.

One attempt at solving the problem of inefficient storage and retrieval of an imbricated copy stream has been widely adopted by the printing industry. This solution involves storing the individual printed copies within their imbricated formation directly upon large storage spools using a reel for winding the copies upon the spool. As the copy stream moves down the conveyor, the imbricated formation is placed upon a strip of continuous separating tape that is subsequently wound tightly upon large spools. A full spool of stored printed copies is cylindrical in shape and stores a single row of an imbricated copy stream. This technology was primarily developed and marketed by a European corporation, Ferag.

Although Ferag's reeling machines solve the problem of inefficient storage and retrieval by maintaining the imbricated formation during storage and retrieval, there are other disadvantages that arise in using Ferag's approach to the problem. First, the storage spools do not use storage space efficiently. The most efficient shape for storing materials is a cubic-shape, and the most common form to achieve the cubic-shape is upon a rectangular pallet. Cylindrical spools inherently waste storage space. Additionally, the cylindrical spools waste space at their respective centers. A second disadvantage of Ferag's machines is that cylindrical spools are inherently more difficult to handle. Pallets are the most common form of storage, and forklifts and other machines are built to handle rectangular pallets. Handling of cylindrical spools require special equipment that is more expensive and more complicated to maintain and operate. A third disadvantage is that copy stream is stored on a curved path that temporarily deforms the normally flat printed copies. This makes handling the partially deformed copies more difficult, upon retrieval. A fourth disadvantage is that when handling and storing newspapers upon a spool, every other individual newspaper must be turned 180° prior to storing the newspapers. This is because the secondary folds of each newspaper make the newspaper thicker at one side, and the newspapers must be alternated to keep the spool balanced in width.

Another alternative approach to vertical stacking of printed copies was developed by the Harris Corporation (now Harris Graphics, Inc.). Harris used special trays to form substantially horizontal stacks of newspapers, signatures, and other types of printed material. As the imbricated copy stream exits the conveyor, the copy stream is compressed upon an elongated tray such that the individual copies are standing almost vertically on end. Individual trays can subsequently be stacked, one on top of the other upon a pallet.

The Harris tray approach has not been found to be commercially viable within the printing industry. Although this approach allows the use of cubic-shaped storage units upon pallets, in contrast to Ferag's storage method, it still does not resolve the basic problem of inefficient destroying and reforming of the imbricated copy stream during storage and retrieval, respectively. Additionally, there are several other disadvantages associated with the use of Harris' storage method. First, this method requires specially formed trays that would be expensive. Second, some storage space is wasted between the top edge of the horizontal stack and the bottom of the next tray. Third, horizontal stacking of printed materials may deform the edges of individual printed copies. Fourth, the relatively narrow and long trays would be relatively unstable when stacked upon one another in a pallet arrangement.

In addition to the problems associated with the use of the machines developed by Ferag and Harris, noted above. There are common problems associated with all prior art storage methods and machines. First, all of them are relatively slow in the total time that it takes to store and retrieve the printed copies from and to a conveyor. Even the amount of time that it takes to store and retrieve the copies with the Ferag method can be improved upon. Second, all of the prior art storage methods use a single row storage method. Efficiency in time and storage space may be improved with the use of a multiple row storage system. Finally, none of the prior art methods use a relatively flat and linear imbricated form for storing a printed copy stream. The relatively flat lay of the copy stream is the most stable way to store the individual copies, and allows the stack to remain stable even if the individual copies are unsymmetrical in size and/or shape. The prior art stacks and machines are not efficient in storing such unsymmetrical articles.

SUMMARY OF THE INVENTION

It is an object of this invention to provide a method and apparatus for storing an imbricated copy stream upon a pallet that is faster and more efficient than present prior art systems.

Another object of the invention is to provide a method and apparatus for forming a compact and cubic-shaped stack that takes up less space per printed copy than present prior art systems.

Another object of the invention is to provide a method and apparatus for storing an imbricated copy stream in a relatively flat and horizontal position to avoid deformation of individual copies while in storage.

It is a further object of the invention to provide a method and apparatus for forming a stack wherein the individual copy streams are self-supportive on the stack and do not require special supports for supporting individual printed copies.

Other objects of the invention will be apparent hereinafter from the specification and from the recital of the appended claims, particularly when read in conjunction with the accompanying drawings.

The present invention comprises a method and apparatus for forming a stack of imbricated copies of printed material on a pallet. A plurality of conveyors feed a shuttle assembly with imbricated copy streams upon a plurality of side-by-side rows. Once filled, the shuttle is positioned over a relatively flat separator sheet and drops the plurality of rows onto the separator sheet, thereby forming a single layer. The layer is placed directly upon a stack which is formed upon a pallet. The separator sheet of the formed layer is supported by the copy streams which lie below on the preceding separator sheet. The resulting stack is cubic-shaped and includes a plurality of layers of a plurality of side-by-side rows of relatively flat and horizontal imbricated copy streams that run the full width of the pallet. The present invention further comprises a method of retrieving the copy streams from the stack and placing them back upon the conveyors. The same apparatus for forming the stack is also used to retrieve the copy streams from the stack and place the streams back upon the conveyors.

DETAILED DESCRIPTION OF THE INVENTION

Figure 1:
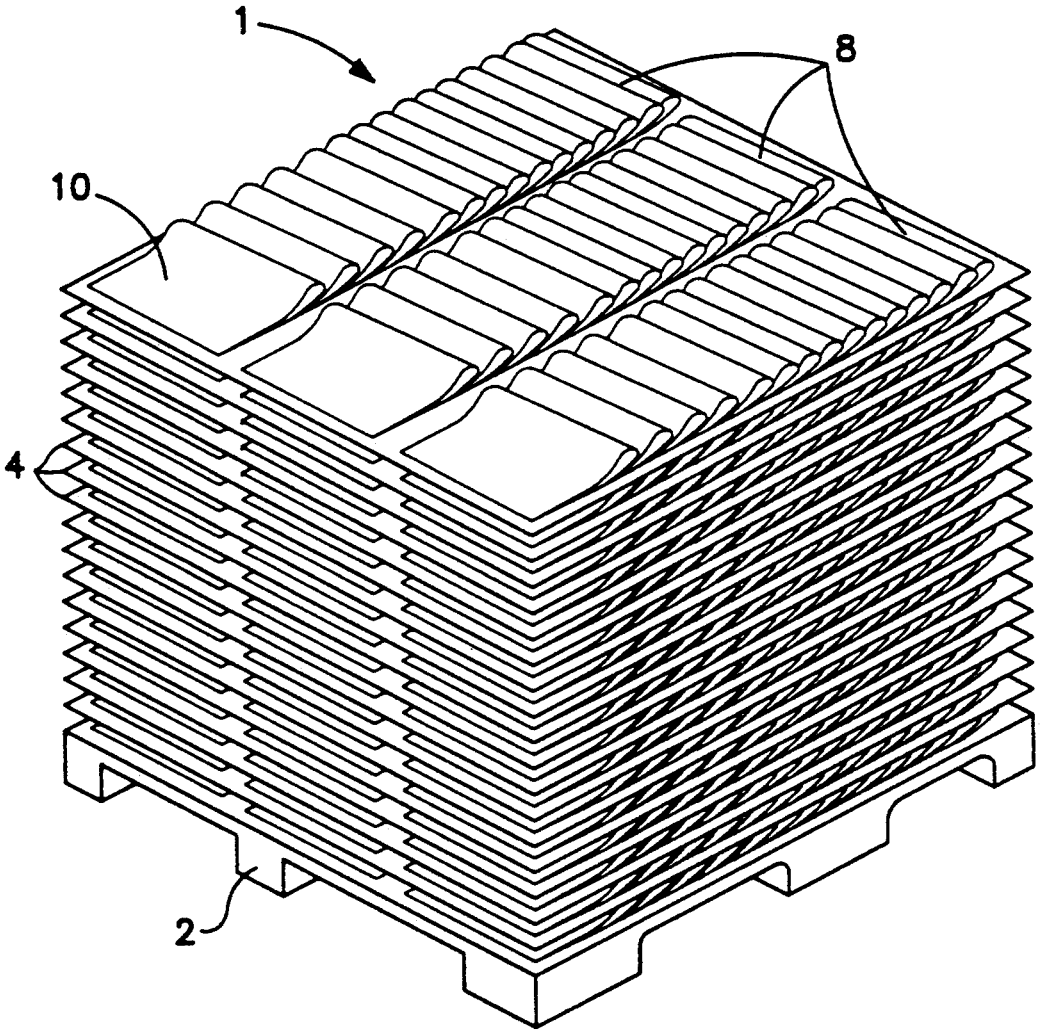
FIG. 1 shows a perspective view of the formed pallet of imbricated copy streams of the present invention.

FIG. 1 shows the preferred embodiment of the formed stack of imbricated copy segments of the present invention. The vertical stack 1 includes a pallet 2 onto which a plurality of horizontal layers 4 are stacked. Each layer includes a separator sheet that supports three rows or segments 8 of imbricated copy stream. The segments of copy stream are made up of uniform copies of printed material 10 that are arranged in an overlapped manner. The printed material could include newspapers, magazines, signatures, etc., and can be bound, unbound, or folded (as shown).

There are many important elements to the design of the stack shown in FIG. 1. First, the copy stream segments remain in their imbricated or overlapped form which is a common form used in moving and conveying printed materials. Second, the copy stream segments remain in a substantially flat configuration. This prevents deformation of individual copies since they aren't stored on their edges or on an arcuate path, as are the aforementioned prior art storage systems. Third, the layers are stacked one on top of the other to form the most compact and space saving stack, possible. Finally, the stack is formed in a substantially cubic shaped unit that can be placed on a pallet, as shown. Also, the cubic form of the stack uses storage space more efficiently than any cylindrical storage system.

Figure 2:
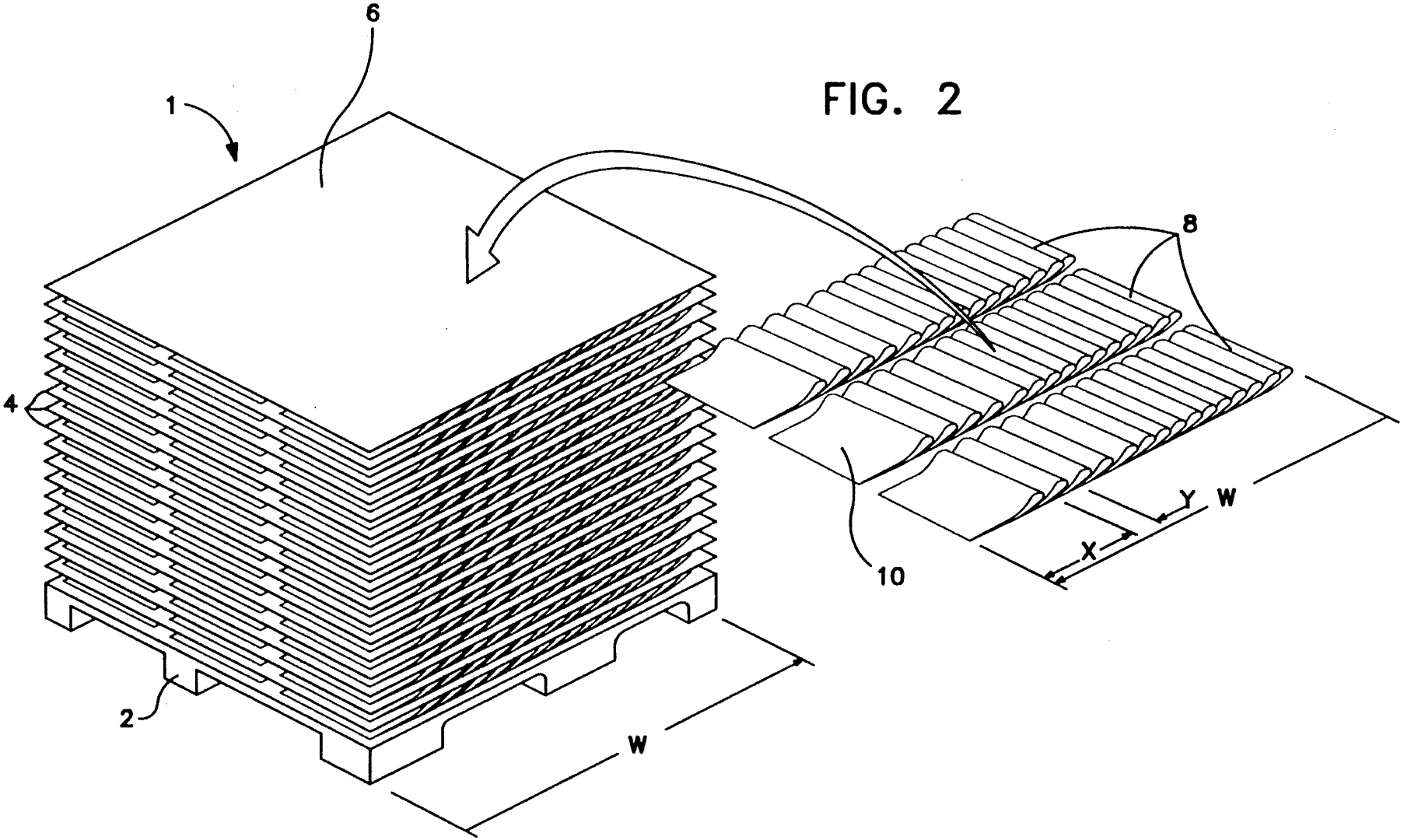
FIG. 2 shows a perspective view of the sequential forming of individual layers within the stack of FIG. 1.

FIG. 2 shows the sequence of the stack formation. Individual separator sheets 6 are placed atop a stack during formation. Three rows or segments 8 of copy stream are received in a holding area, and are subsequently shuttled over the separator sheet. The building of the new layer of the stack is complete when the three rows are dropped upon the separator sheet allowing another layer to begin.

The dimensions of the stack 1, layers 4, rows 8, and articles 10 are important within the interrelationships of these components. Individual copies 10 have a storage width X and are overlapped by a distance Y upon the next copy. FIG. 2 shows the copies as folded, but it should be appreciated that the copies could be single or multi-paged unfolded units. Additionally, the overlapped configuration could be made so that the folds of the copies are arranged along the length of the row instead of the width of the row, as shown. The overlapped or imbricated formation of the individual copies 10 is constructed by conventional printing equipment. The stack is formed from a plurality of in-feed conveyors of continuous streams of imbricated copies of width X and overlap Y, as will be explained later in the specification. The overlap Y is determined by the thickness and width of an individual copy, so that it may lay in a substantially flat manner in its overlapped configuration. The thicker the copy, or the less the width, the greater the overlap Y needs to be in order to preserve the substantially flat configuration of the copy stream.

The stack is formed by separating the continuous streams into segments of length W. These segments are arranged in side-by-side parallel rows as shown to the right side of the stack within FIG. 2. The length W is predetermined as the width of the pallet 2. The overlap Y of the copy stream segments remains unchanged. This is directly different from the Harris stack of trays, noted above, where the overlap is removed by compacting the individual copies upon the individual trays. The number of rows or segments 8 upon each separator sheet is determined by the width of the copy W and the length of the pallet. In this case, three rows fit across the length of a single pallet.

Figure 3:
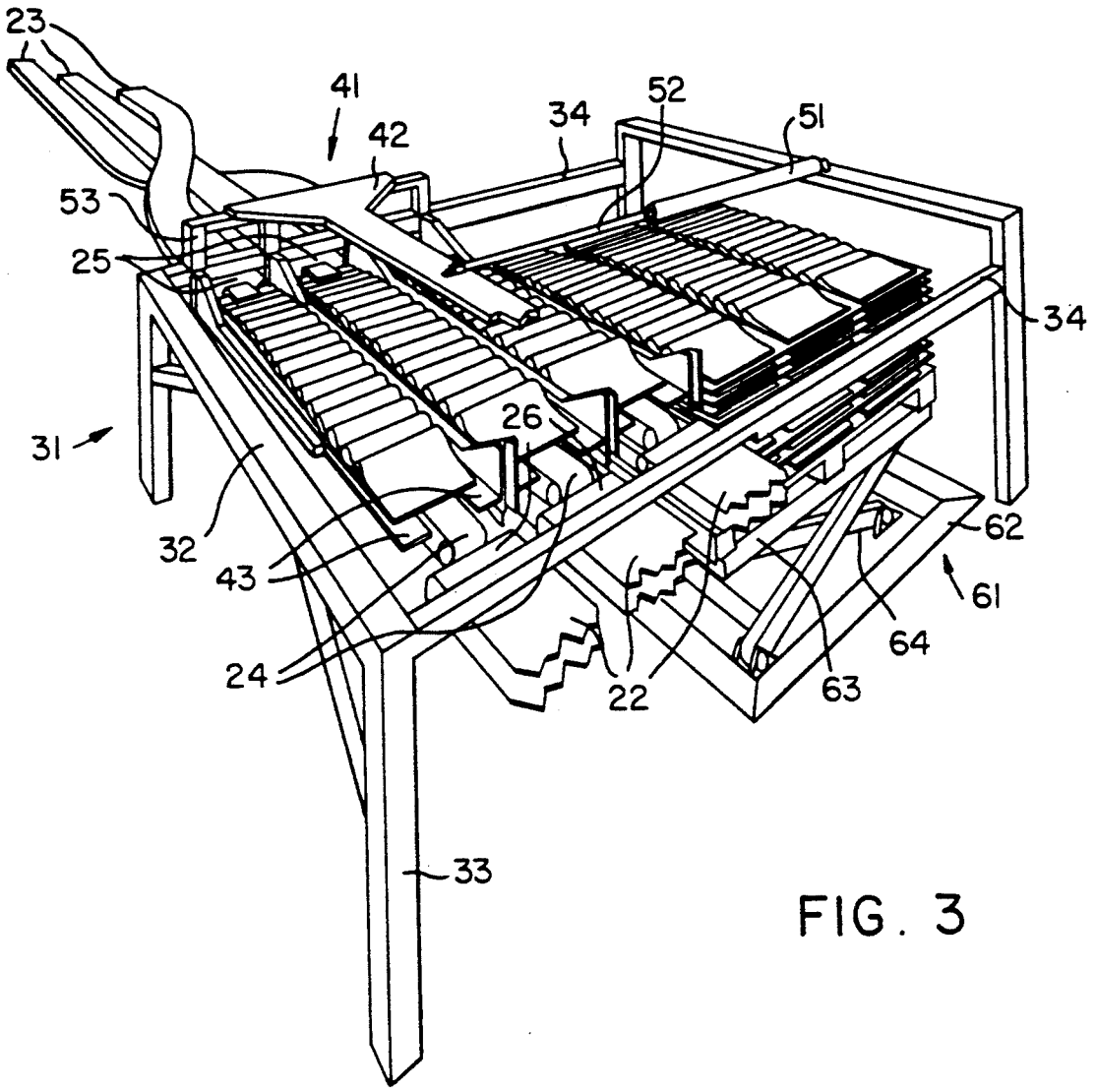
FIG. 3 shows a perspective view of the apparatus for forming the stack of FIG. 1 and for retrieving the copy streams from the stack.

FIG. 3 shows the apparatus for forming the stack of FIGS. 1 and 2. The apparatus is divided into four separate units: the conveyor assembly 21, the apparatus support frame 31, the shuttle assembly 41, and the pallet elevator assembly 61.

The conveyor assembly includes in-feed conveyors 22 and retrieval conveyors 23 for feeding and receiving a continuous imbricated copy stream of overlapped printed materials, respectively. Between the end 25 of conveyor 23 and the end of conveyor 22 lies a central holding conveyor 24. The central conveyor is narrower in width than either of conveyors 22 or 23. The central conveyor is arranged to temporarily hold a segment of imbricated copy stream before being placed upon the stack or before being moved onto the retrieval conveyors 23.

The apparatus support frame 31 includes an open rectangular frame 32 for holding the shuttle assembly 41. Four legs 33 at each corner hold the frame at a height greater than the height of a full pallet of imbricated copy stream allowing the pallet elevator assembly 61 to be positioned entirely within the frame 32. Parallel guide tracks 34 extend across the entire length of the frame and support the shuttle assembly 41 for movement across the length of the frame 32.

The shuttle assembly 41 includes a shuttle frame 42 which includes hinged gates 43 at the bottom of the shuttle frame. A hydraulic actuator 51 moves the shuttle assembly back and forth across the top of the frame 32 by extending or retracting the elongated piston rod 52. Guide bars 53 on either side of the shuttle assembly (only one of which is shown for clarity reasons in the broken away view of FIG. 3) cooperate with the guide tracks 34 of the frame to allow the shuttle assembly to move easily across the frame.

The pallet elevator assembly 61 includes a base 62 positioned to the side of the conveyor assembly 21. A vertically movable platform 63 supports the pallet for movement up and down depending upon how full the stack is. Lifting arms 64 connect the platform to the base.

Figure 4:
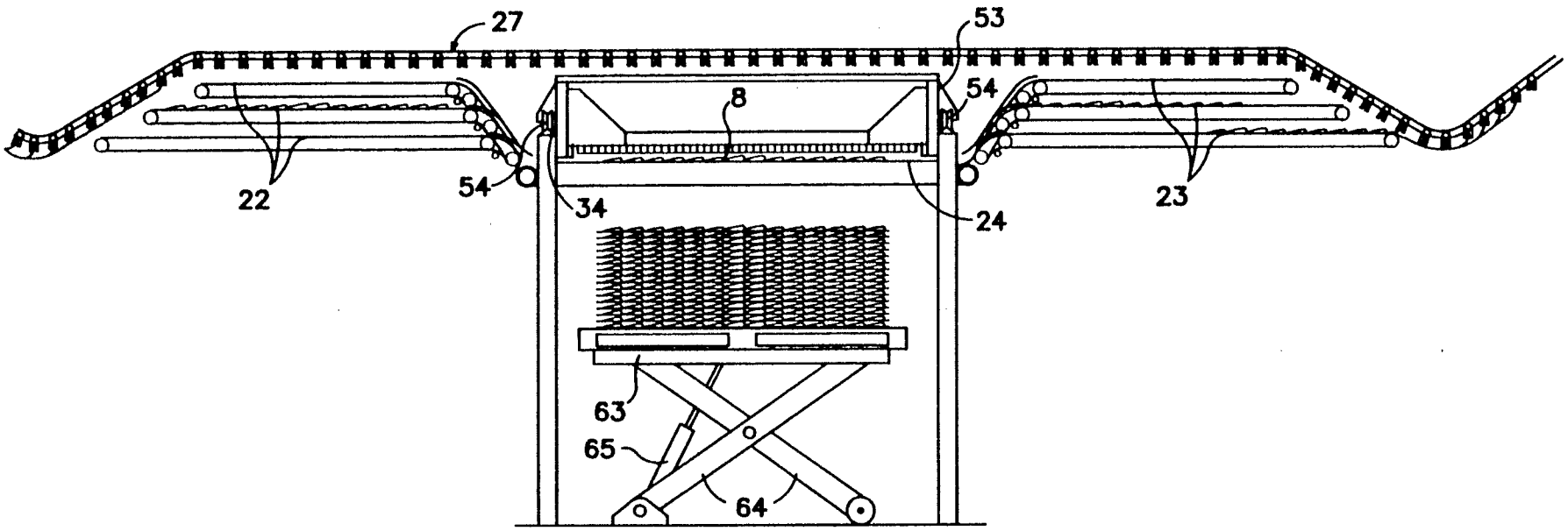
FIG. 4 shows a side view of the apparatus of FIG. 3.

FIG. 4 shows an end view of the apparatus of FIG. 3 to reveal several features hidden within FIG. 3. The guide bar 53 moves easily over the track because guide wheels 54 connected to the guide bar mate with the top of track 34 and allow the shuttle assembly to roll back and forth upon the frame. The platform 63 is moved up and down by a hydraulic actuator 65. Lifting arms 64 pivot to allow the platform to remain in a horizontal plane.

FIG. 4 also shows further details of the conveyor assembly. As related above, the most common form that printed materials are conveyed in is within a continuous overlapped copy stream. The conveyance can be done entirely upon endless belt conveyors such as in-feed and retrieval conveyors 22 and 23 of FIG. 3. Alternatively, the printed materials can be delivered by a gripper conveyor 27 which deposits individually spaced printed copies upon an in-feed conveyor 22 to form an imbricated formation upon the endless belt conveyor. The gripper conveyor can also be used to pick up individual copies from the retrieval conveyor 23, as shown.

Figure 5:
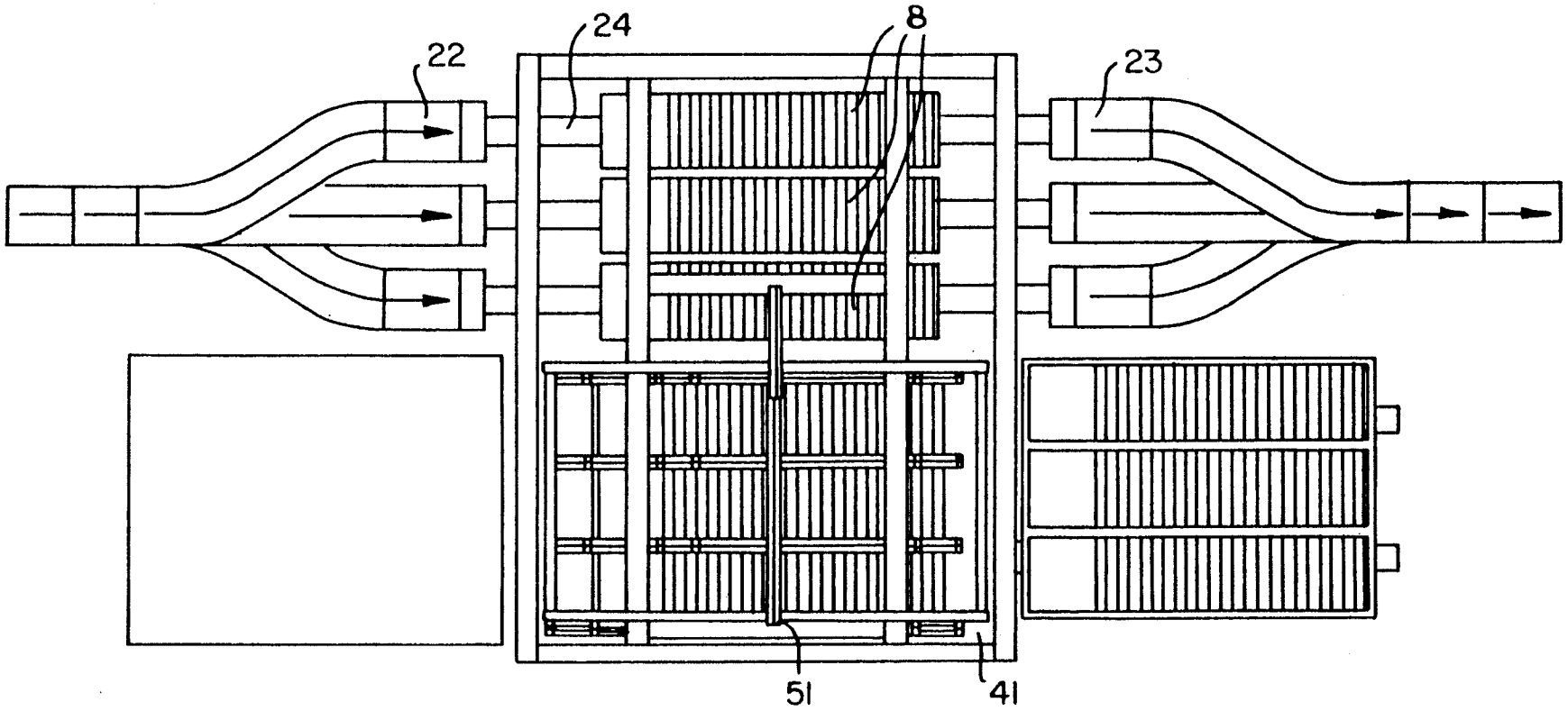
FIG. 5 shows a top plan view of the apparatus of FIG. 3.

FIG. 4 also shows the ends of the central conveyor 24 positioned between the ends of in-feed and retrieval conveyors 22 and 23 to allow the easy transfer of the copy stream from one conveyor to the next. The central conveyor receives a segment or row 8 from the continuous copy stream in-feed conveyor 22. The central conveyor temporarily holds the segments before the shuttle assembly transfers the segments to the stack. When retrieving the copy stream from the stack, the shuttle assembly moves the segments of the copy stream back to the central conveyors 24 where they are subsequently transferred to the retrieval conveyors to form another continuous copy stream. Further details of the conveyor assembly can be seen in FIG. 5 which shows a view from above the apparatus. Three separate storage conveyors 22 feed three central conveyors 24. The three central conveyors also feed three retrieval conveyors 23. It should be noted that the preferred embodiment allows the stack to be built with three rows, but it should also be appreciated that the invention could also be achieved with any number of rows from one to many.

Figure 6:
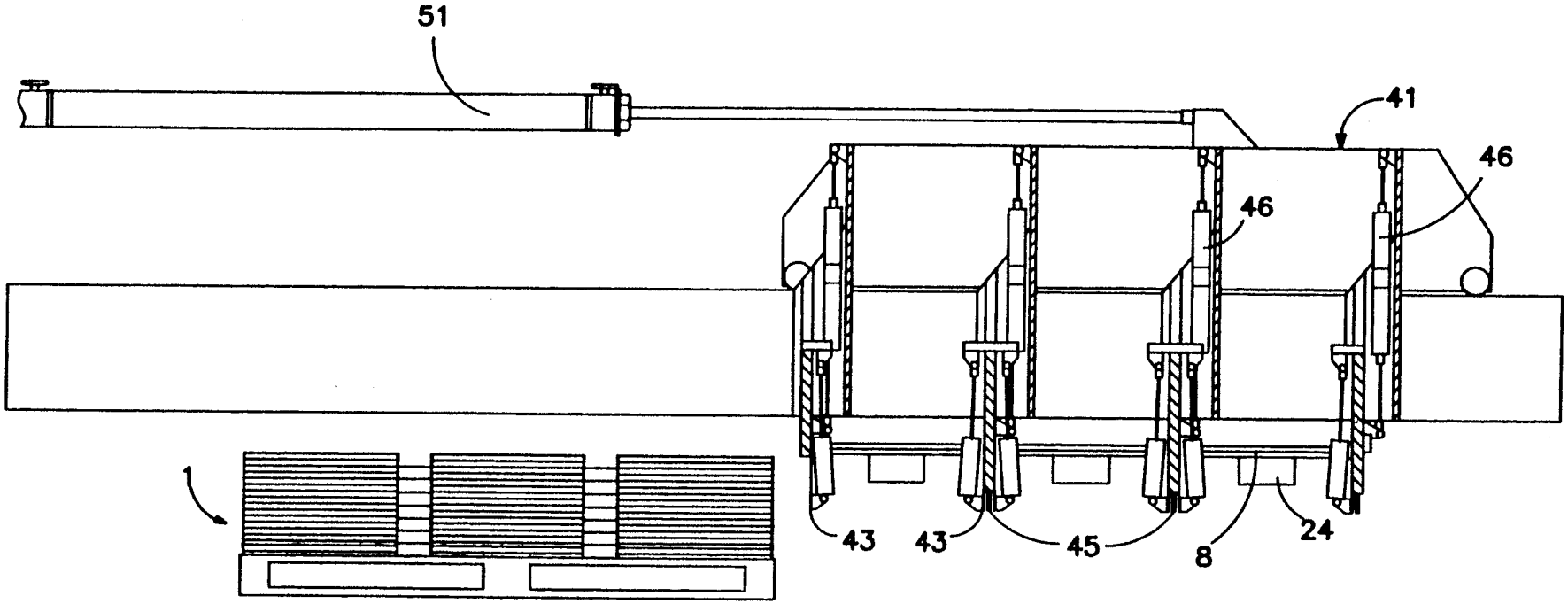
FIGS. 6–9 show sequential side views of the storage cycle of the apparatus of FIG. 3.

Details of the hinged gates 43 of the shuttle assembly may be seen in FIG. 6, which is a cross-sectional view of the stack and apparatus at the beginning of a storage cycle. The gates 43 are hinged to the apparatus and are movable from a horizontal position, shown in FIG. 7, to a vertical retracted position, shown in FIG. 6. The gates are moved by hydraulic actuators 44 that include pistons that are pivotably connected to the gates to swing the gates between their vertically retracted and horizontally extended positions.

Figure 11:
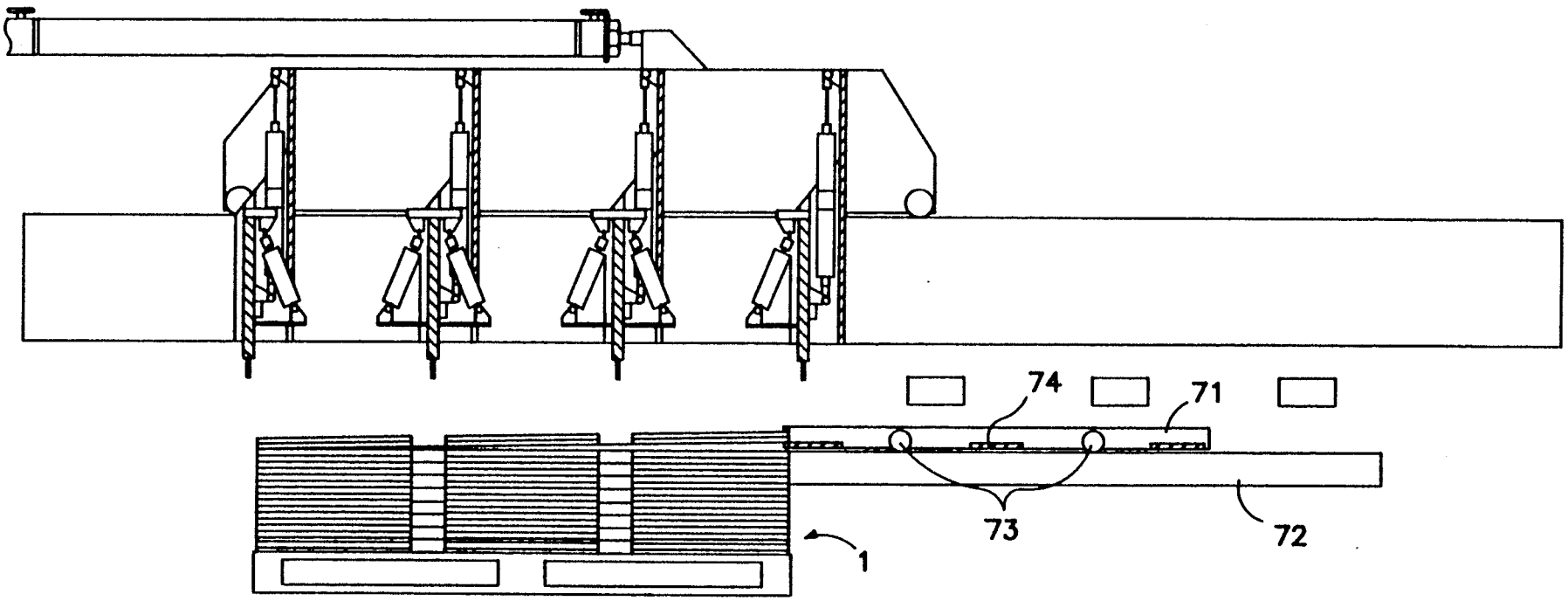
FIGS. 11–14 show sequential side views of the retrieval cycle of the apparatus of FIG. 3.

Details of the retrieval cycle are best viewed in FIG. 11 which is a cross sectional view similar to FIG. 6. This view also shows the layer separator tray 71 which was left out of FIG. 3 for clarity reasons. The layer separator tray is mounted for rolling movement upon a guide track 72 which cooperates with guide wheels 73. Three layer supports 74 extend across the width of the tray and serve the dual purpose of lifting an individual layer off of the stack, as shown in FIG. 11, and supporting the three copy stream segments once the separator sheet is pulled out from beneath the segments, see FIG. 13.

Figure 12:
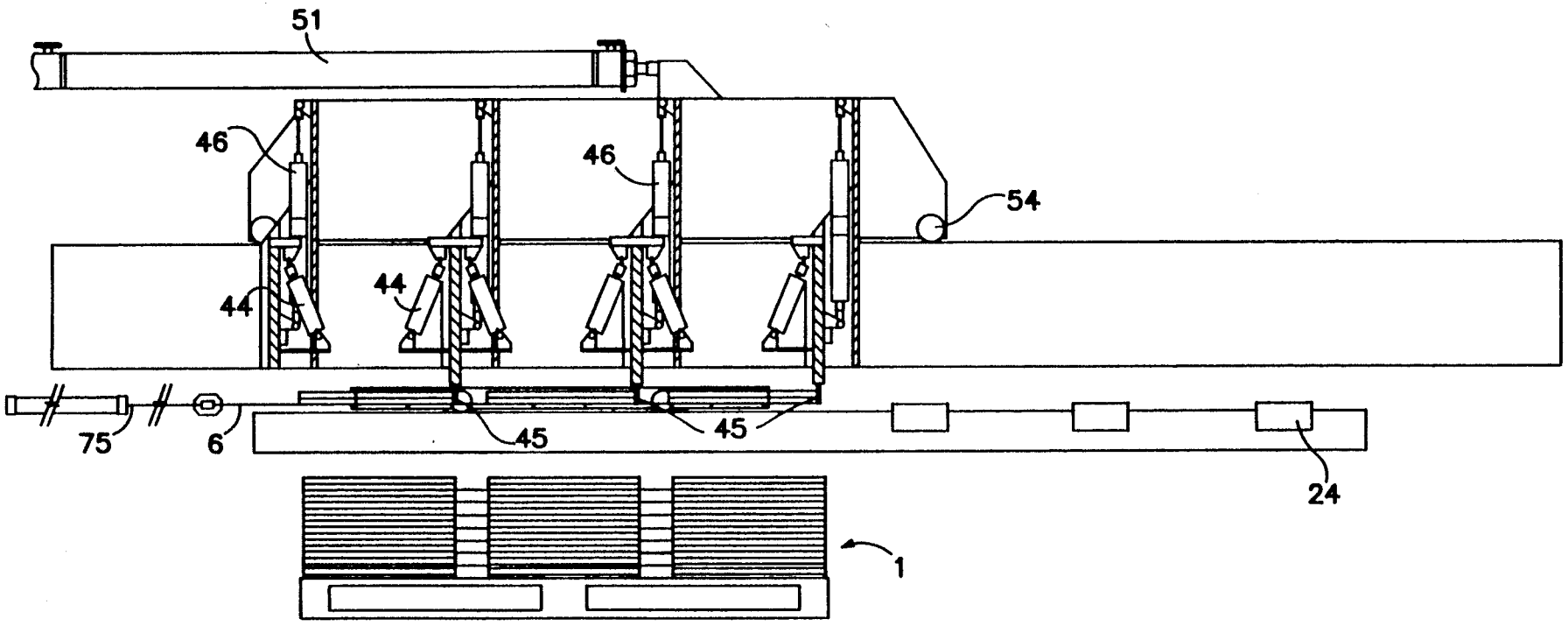

FIGS. 11 and 12 also show details of the copy blocking partitions 45 mounted on the shuttle assembly to maintain the copy stream segments, in place, upon the layer supports 74 of the layer separator tray while the separator sheet is pulled out from beneath the copy stream segments. The copy blocking partitions include flexible strip brushes at their ends to maintain frictional contact with the separator sheet as it is pulled away while preventing the copy streams from moving during this process. The copyblocking partitions are also vertically movable up and down by hydraulic actuators 46 to allow the shuttle assembly to clear the central conveyors when moving from the conveyor position to the stack position. The separator 6 is pulled by a sheet puller 75 which clamps upon the end of the sheet and hydraulically pulls the sheet from beneath the copy streams.

Figure 7:
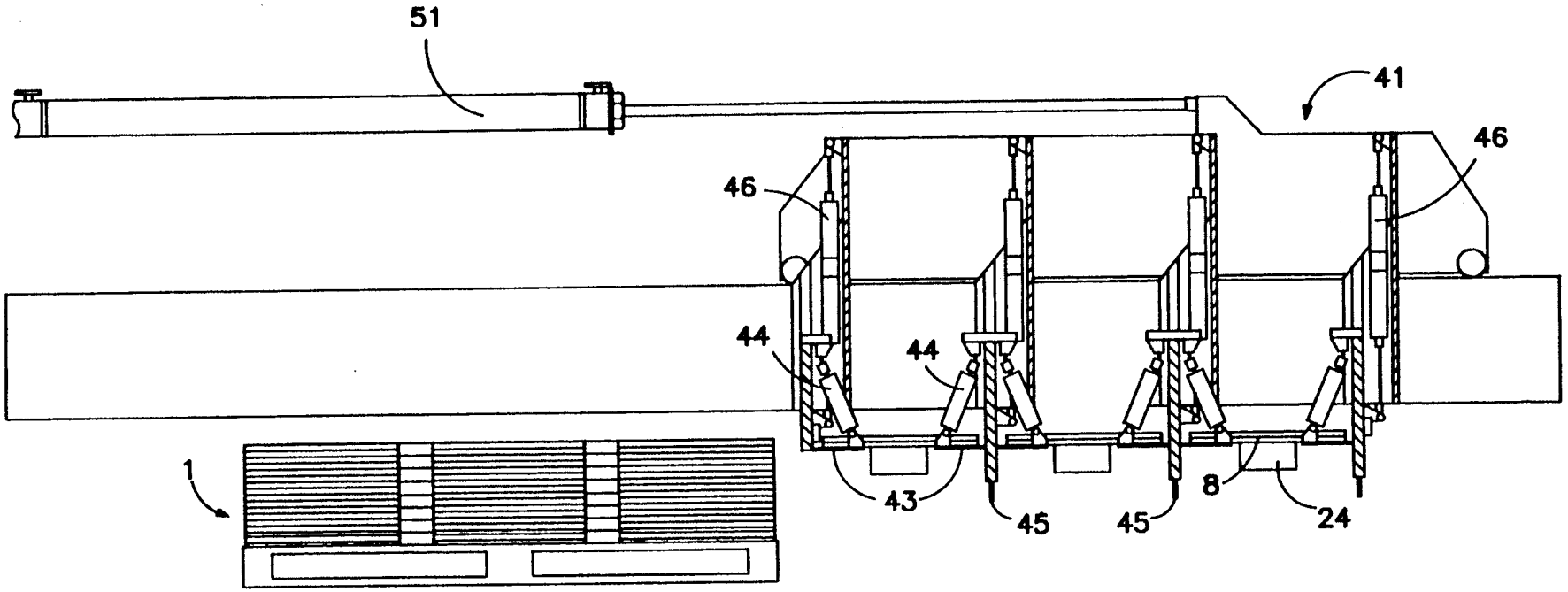
Figure 8:
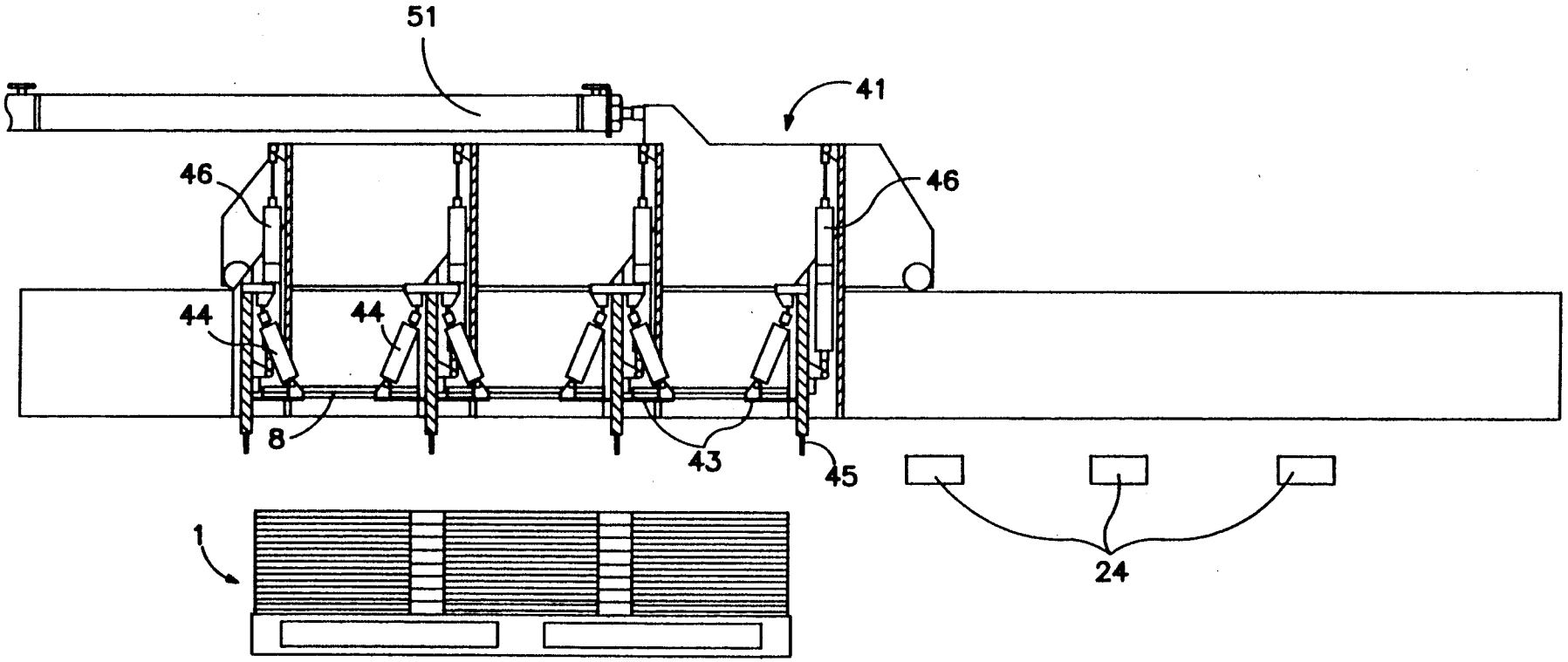
Figure 9:
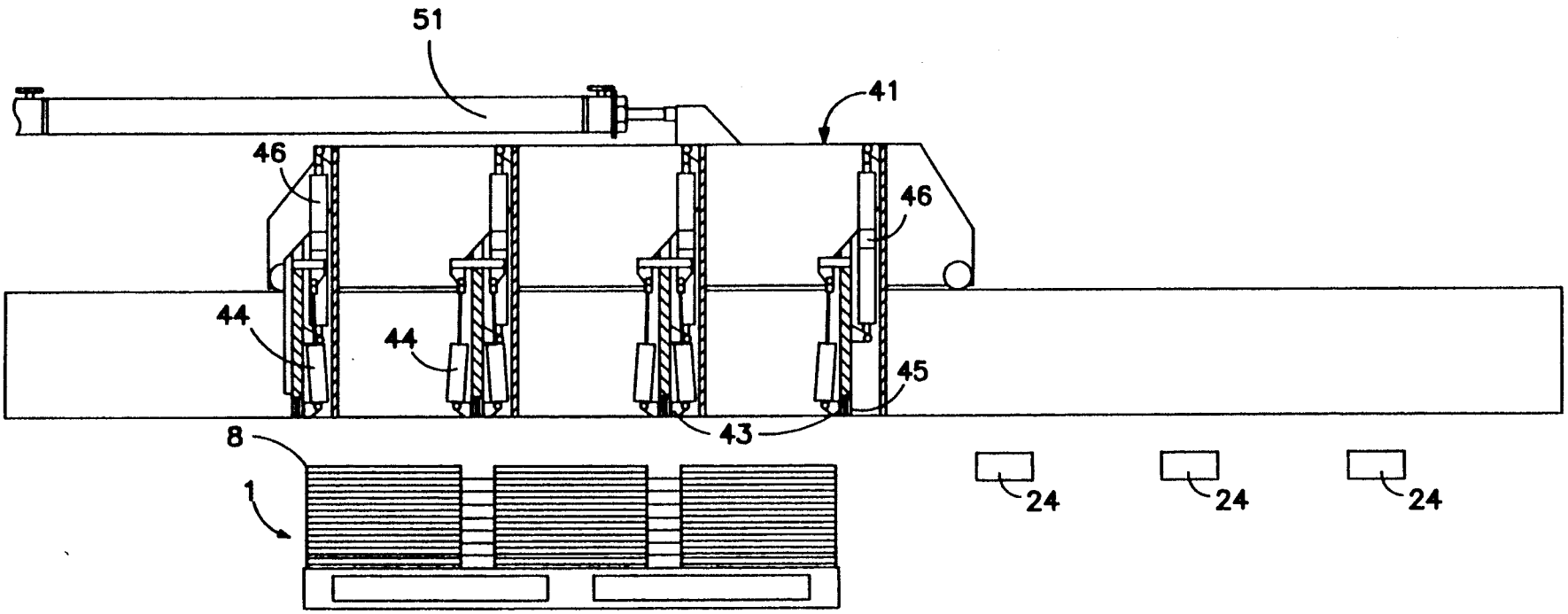
Figure 10:
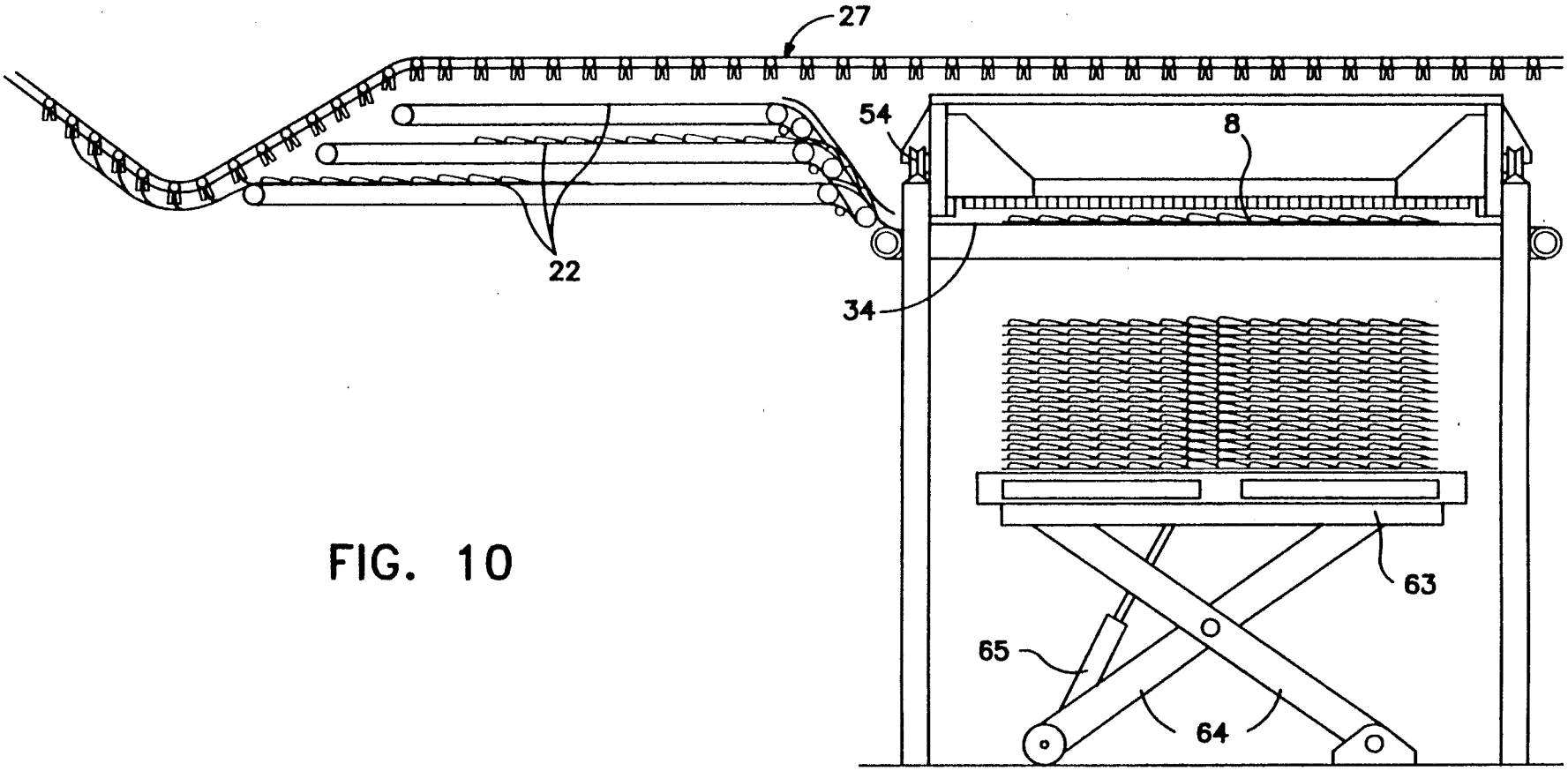
FIG. 10 shows an end view of the storage cycle of the apparatus of FIG. 3.

The storage cycle of the apparatus is best seen within the sequential views of FIGS. 6–9 and the end view of FIG. 10. The storage cycle is also the method by which the stack of the present invention is formed. The first step is to form three continuous rows of imbricated copy stream and convey these continous streams to the apparatus, as best seen in FIG. 10. At this point, the shuttle assembly 41 is positioned adjacent the in-feed conveyors 22 to the right of the stack 1 by the hydraulic actuator 51, as viewed within FIG. 6. The second step of the storage cycle is to divide the three continuous streams into three separate segments or rows 8 of a predetermined length and move these segments onto the central conveyors 24. The predetermined length is approximately equivalent to the length of the pallet or separator sheet. In this position, as seen in FIG. 6, the hinged gates 43 are fully extended downwardly so that they do not interfere with the transfer of the segments to the central conveyors. The third step involves placing another separator sheet upon the stack, as best seen in FIG. 7. At this point the gates 43 are pivoted to a horizontal position to lift the copy stream segments 8 off of the surface of the conveyors 24. The fourth step involves pulling the shuttle back with the hydraulic actuator 51, as seen in FIG. 8, such that the segments 8 are positioned above the stack. At this time, the copy blocking partitions 45 are raised by hydraulic actuators 46 so that the shuttle may move to the left, as seen in FIG. 9. It should be noted that at all times, the original imbricated form of the printed materials is maintained. The final step, FIG. 9, involves placing the segments 8 upon the separator sheet 6 to form a new layer of the stack. This is done by vertically extending the hinged gates 43 to allow the segments of copy stream to drop upon the separator sheet. A cycle is completed by moving the shuttle back to its position to the right of the stack, FIG. 6, to receive the next three segments of copy stream, and moving the stack down the distance of one layer by the stack elevator assembly.

Figure 13:
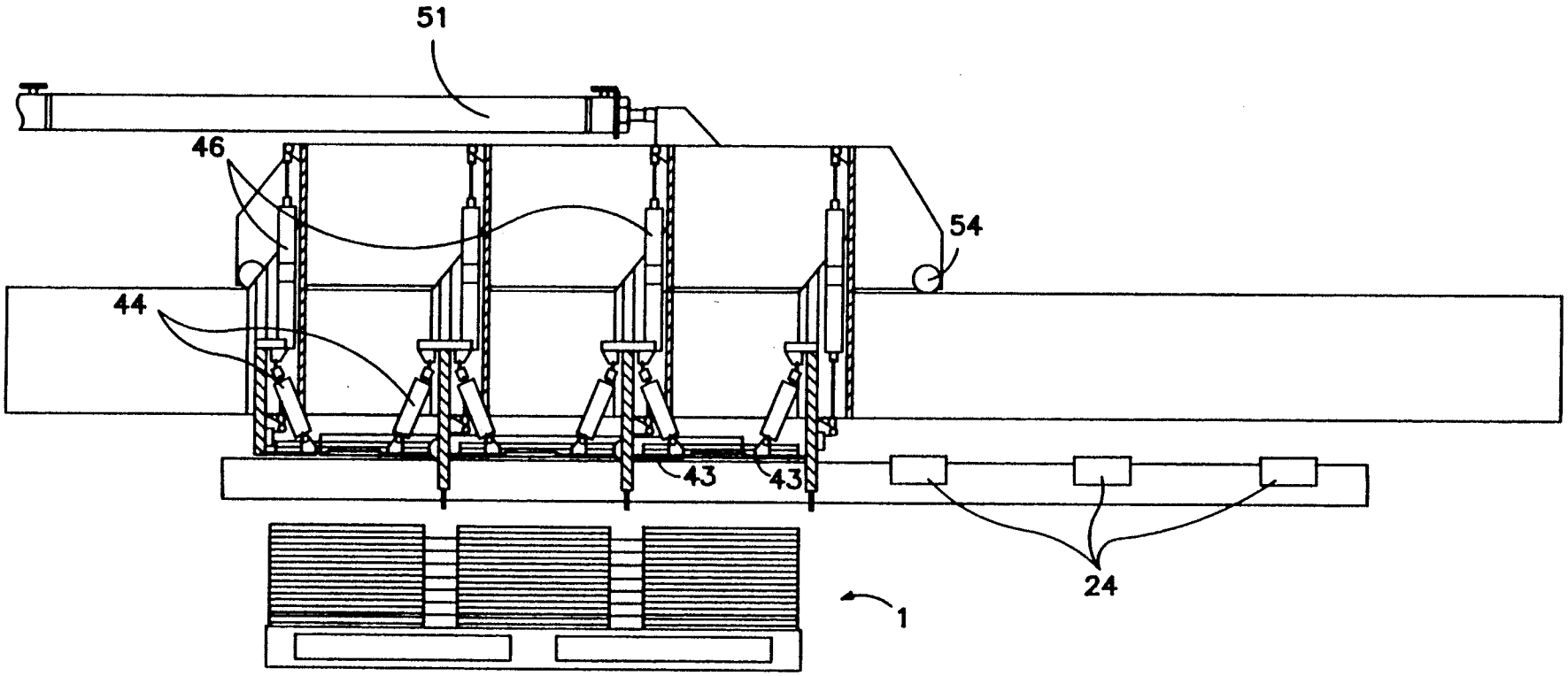
Figure 14:
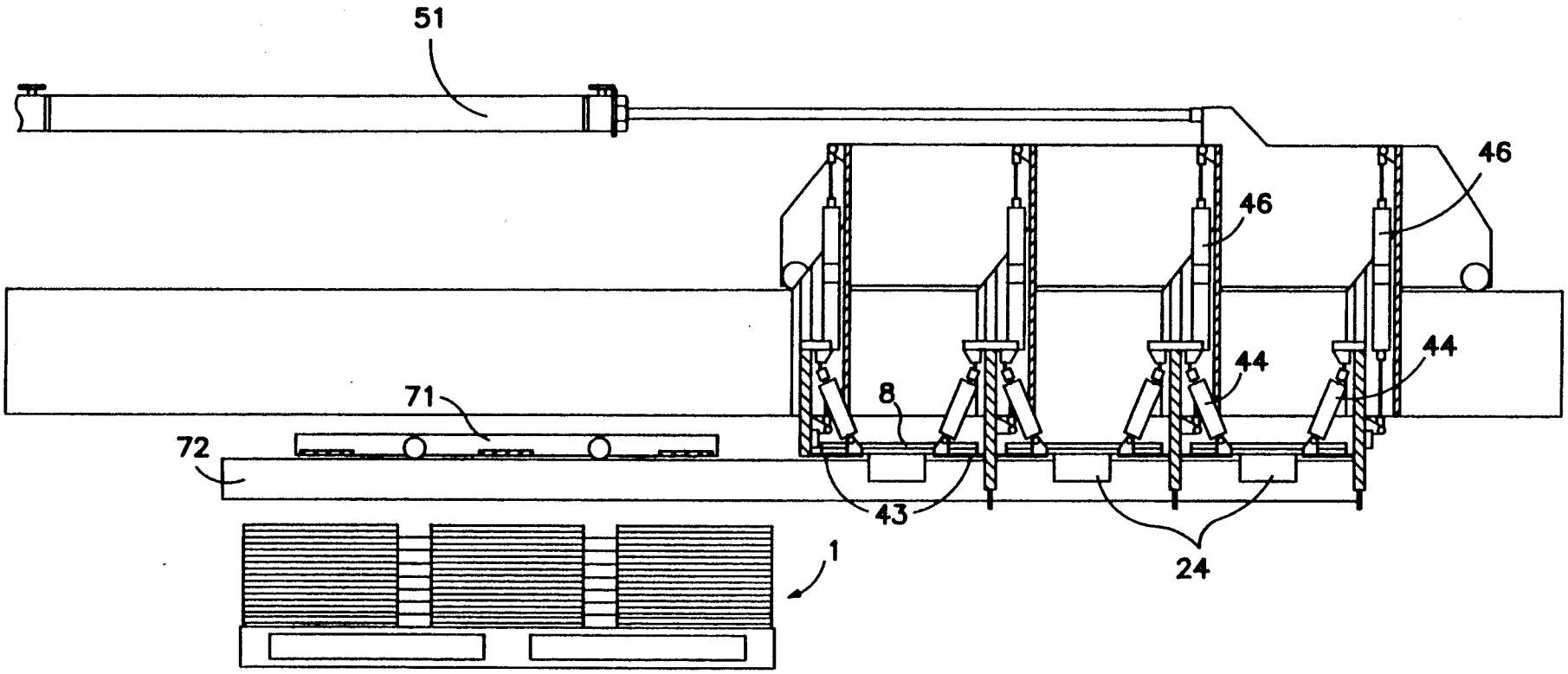
Figure 15:
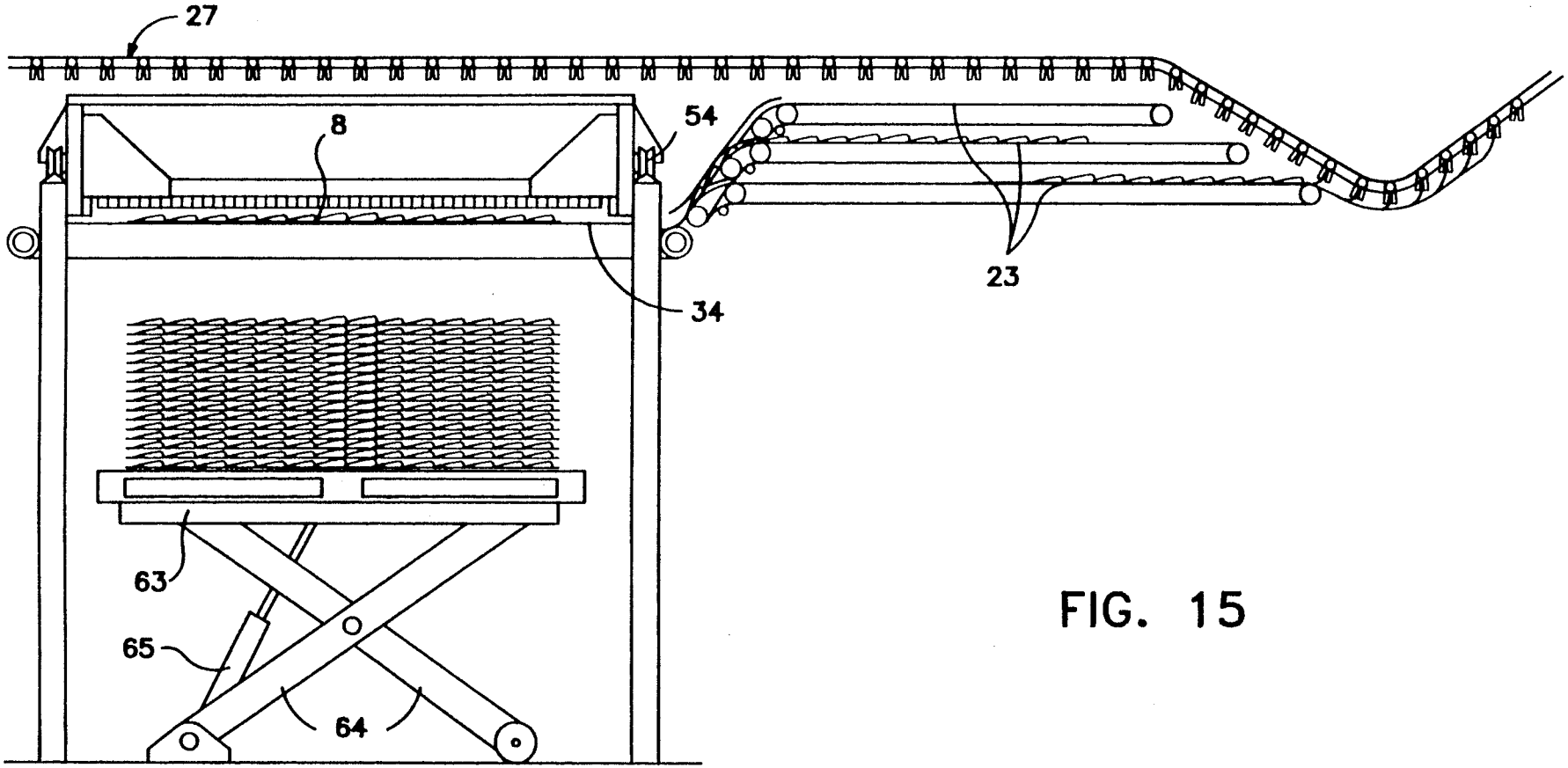
FIG. 15 shows an end view of the retrieval cycle of the apparatus of FIG. 3.

The retrieval cycle of the apparatus is best seen within the sequential views of FIGS. 11–14 and the end view of FIG. 15. The retrieval cycle is also the method by which the stack of the present invention is dismantled. The first step is to position the stack 1 to the left of the conveyors 24, as seen in FIG. 11. The layer separator tray 71 moves upon its guide track 72 such that the lead edge of the first layer support 74 moves beneath the separator sheet 6 to separate the top layer from the remainder of the stack. The layer separator tray continues to move beneath the top layer until the entire layer is supported upon the tray, as seen in FIG. 12. The second step is to remove the separator sheet 6 by lowering the copy blocking partitions 45 such that the strip brushes at the ends of the partitions abut the sheet 6 and block the copy streams 8 from moving while the sheet puller 75 draws the sheet out from beneath the copy streams, as shown in FIG. 12. At this time, the individual rows of copy are stream are positioned on the layer supports 74 with gaps between each row. To prepare for the third step, the hinged gates 43 are rotated to vertically extended positions (not shown). The third step is to further lower the copy blocking partitions 45 and hinged gates 43 through the gaps between the rows 8 of copy stream until the gates and partitions are positioned beneath the tray 71. The gates are then rotated upwardly to support the copy streams at their edges, as shown in FIG. 13. The fourth step is to raise the gates and partitions to lift the copy streams off of the tray 71, and subsequently move the shuttle assembly over the top of the central conveyors 24, as seen in FIG. 14. The final step is to retract the gates 43 and allow the copy streams to be carried away by the central and retrieval conveyors, as seen in FIG. 15. The cycle is completed by raising the stack the thickness of one layer, and moving the shuttle assembly to a position above the stack.

The stack of the present invention and the apparatus for assembling the stack are unique from the prior art machines. In addition to the points made above, there are other advantages to the present invention over the prior art machines. First, the relatively flat lay of the copy stream is the most stable way to store the individual copies, and allows the stack to remain stable even if the individual copies are unsymmetrical in size and/or shape. The prior art stacks and machines are not efficient in storing such unsymmetrical articles. Second, the shuttle assembly of the apparatus forms an inherent buffer to the system to allow the removal of one stack while the shuttle is being loaded from the in-feed conveyors. Finally, the cubic shape of the stacks allow the stacks to be vertically stacked upon one another allowing greater efficiency of storage space within a publication facility or warehouse.

It should be apparent that many modifications could be made to the stack of imbricated copy streams, the method of forming the stack, and the apparatus for forming the stack which would still be encompassed within the spirit of the present invention. It is intended that all such modifications may fall within the scope of the appended claims.

What is claimed is:

1. A stack of imbricated copies of printed materials comprising a support for supporting a plurality of said copies, a bottom layer comprising at least one row of an imbricated copy stream of predetermined length, at least one intermediate layer comprising at least one row of said imbricated copy stream, said intermediate layer positioned on a flat separator sheet, said separator sheet supported by the imbricated copy stream of a preceding layer, said intermediate and bottom layer rows being arranged on substantially horizontal and parallel planes to form a vertically extending stack, said bottom layer and said intermediate layer comprising a plurality of rows of said copy stream, said plurality of rows spaced side-by-side and oriented parallel to one another.

2. A stack of imbricated copies of printed materials comprising a support for supporting a plurality of said copies, a bottom layer comprising at least one row of an imbricated copy stream of predetermined length, at least one intermediate layer comprising at least one row of said imbricated copy stream, said intermediate layer positioned on a flat separator sheet, said separator sheet supported by the imbricated copy stream of a preceding layer, said intermediate and bottom layer rows being arranged on substantially horizontal and parallel planes to form a vertically extending stack, each of said bottom layer and said intermediate layer comprising a plurality of side-by-side rows of said copy stream, each of said plurality of rows being substantially coplanar with and parallel to all other rows in said bottom layer and said intermediate layer.

3. A stack of imbricated copies of printed materials comprising a support for supporting a plurality of said copies, a bottom layer comprising at least one row of an imbricated copy stream of predetermined length, at least one intermediate layer comprising at least one row of said imbricated copy stream, said intermediate layer positioned on a flat separator sheet, said separator sheet supported by the imbricated copy stream of a preceding layer, said intermediate and bottom layer rows being arranged on substantially horizontal and parallel planes to form a vertically extending stack, each said separator sheet being unattached to an adjacent separator sheet, and an uppermost said separator sheet being removable from said stack.

4. The stack of claim 3 wherein individual copies of said copy stream of said bottom and said intermediate layers lie substantially flat and horizontal relative to said support.

* * * * *